United States Patent [19]

Saad

[11] 4,094,030

[45] June 13, 1978

[54] SHOE HANGER

[76] Inventor: Michel H. Saad, c/o Dana Electronic Computer Co. Inc., Bldg. 105, Spokane, Wash. 99216

[21] Appl. No.: 814,184

[22] Filed: Jul. 11, 1977

Related U.S. Application Data

[63] Continuation-in-part of Ser. No. 652,625, Jan. 26, 1976, abandoned.

[51] Int. Cl.[2] ..... A43D 5/00; A47F 7/08; A47J 51/00

[52] U.S. Cl. ..... 12/116.8; 211/38

[58] Field of Search ..... 12/114.2, 115.8, 116.8; 211/38; 15/164

[56] References Cited

U.S. PATENT DOCUMENTS

| | | | |
|---|---|---|---|
| 832,498 | 10/1906 | McHenry | 15/164 |
| 2,111,669 | 3/1938 | Lazarus | 12/116.8 |
| 2,553,933 | 5/1951 | Ola | 12/116.8 |
| 2,872,692 | 2/1959 | Moses | 12/116.8 |
| 3,085,272 | 4/1963 | Weichselbaum | 15/164 |
| 3,451,723 | 6/1969 | Marks | 15/164 |
| 3,802,572 | 4/1974 | Shackel | 211/38 |

*Primary Examiner*—Patrick D. Lawson
*Attorney, Agent, or Firm*—Wells, St. John & Roberts

[57] ABSTRACT

A shoe hanger including individual inserts that deform and frictionally engage the inner surfaces of a shoe between the insole and vamp. Each insert includes an elongated core and protruding resilient surfaces spaced along the length of the core for frictional engagement within the shoe. A suitable support extends rearwardly from the core. The resilient members are illustrated as transverse fins or bristles having coplanar lower transverse surfaces and convex upper transverse surfaces. Individual fins are progressively wider and higher relative to one another from front to back along the length of the core.

25 Claims, 19 Drawing Figures

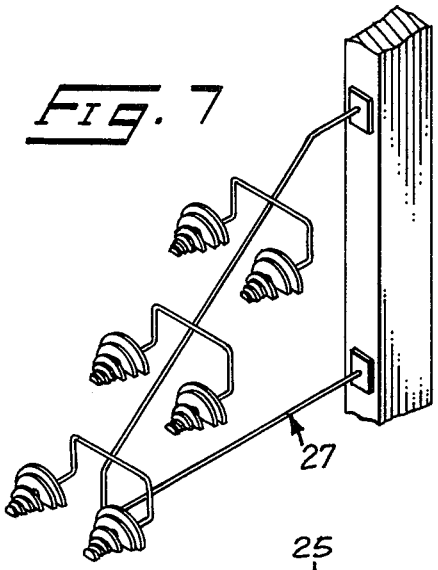
FIG. 7
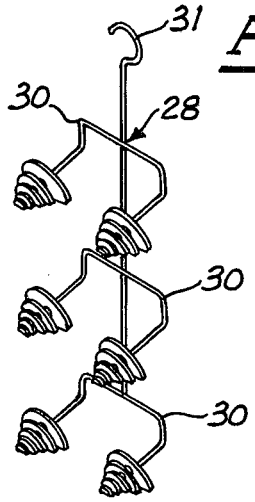
FIG. 8
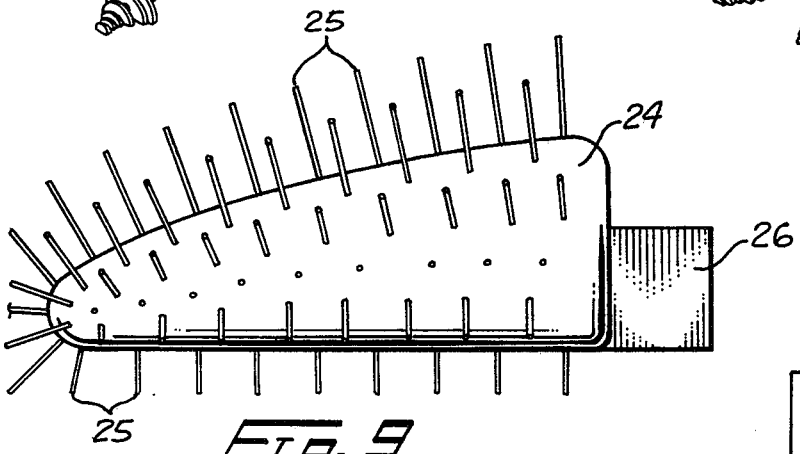
FIG. 9
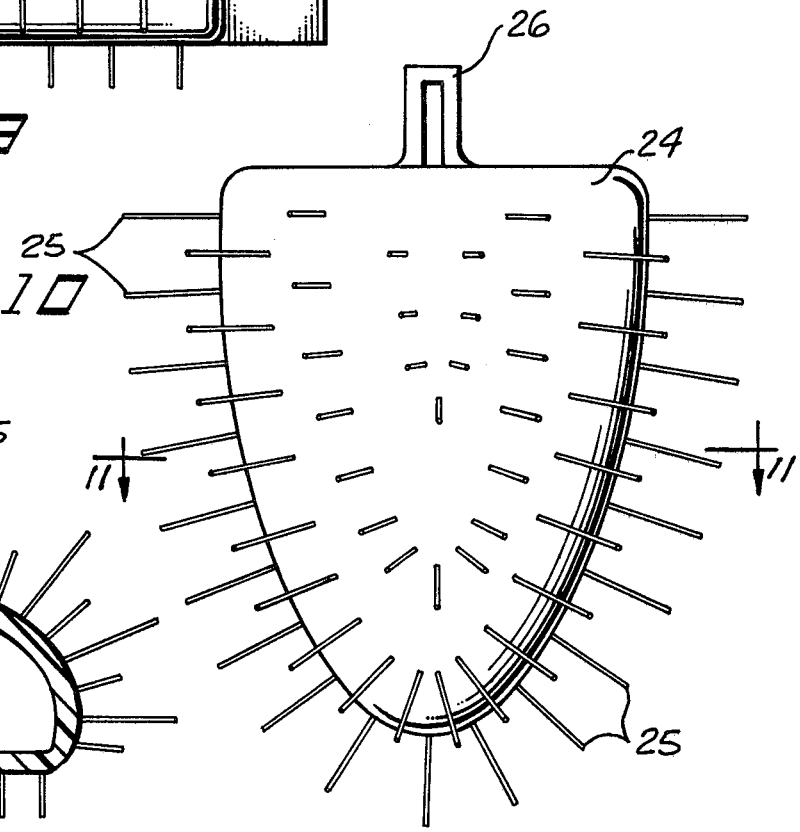
FIG. 10
FIG 11
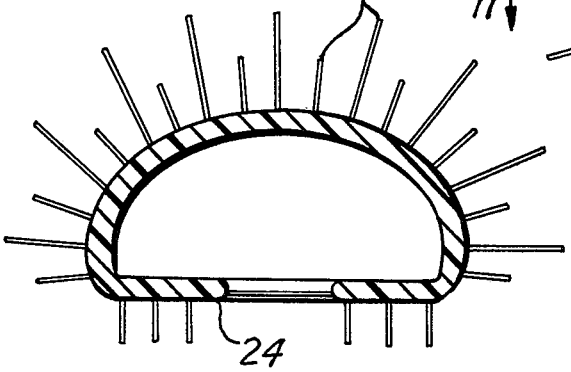

SHOE HANGER

RELATED APPLICATIONS

This is a continuation-in-part of application Ser. No. 652,625, filed Jan. 26, 1976, now abandoned.

BACKGROUND OF THE INVENTION

The display of shoes for retail sales purposes, as well as the storage of shoes by the consumer, is often haphazard and totally lacking in organization. For instance, it is very typical for a consumer to simply store shoes on a floor of a closet with no mechanical assistance whatever. Retail stores often make use of shelves to display samples of shoes which are either loose or tied to one another. Most retail stores continue to store most available pairs of shoes in a backroom, keeping them in individual boxes. Such storage facilities are inaccessible to the public and require high labor intensity for retail sales service.

The present disclosure relates to a shoe hanger that is highly adaptable to most sizes and types of shoes and which can be readily used to frictionally grip individual shoes for display and storage purposes. It lends itself to both self-service sales displays and open displays of shoes for viewing by consumers, even though the actual selection and fitting of the shoe might be aided by sales personnel. The hanger also has utility for consumer use in the storing of the shoes when not being worn.

There have been prior attempts to produce usable racks for individually holding shoes as alternatives to the normal shelves and counters, which do not lend themselves to ready organization of individual shoes. The prior patent to Lebovits shows a rack-mounted tree of shoes, having a rigid forward saddle and a lower longitudinal spring that resiliently bears against the lower portion of the shoe. It extends a substantial length along the inner portion of the shoe and would not be readily adaptable to all forms and shapes of shoes as are now available on the market. The patent to Carver, 678,356, shows another sample display rack, which utilizes external supports to cradle individual shoes. Again, it would pose difficulty in adapting to a wide variety of shoe shapes or sizes.

Besides the above racks, there are a wide variety of shoe trees available today, some of them including expandable toe portions that are forced apart by longitudinal pressure between the rear end of the shoe and the tree. However, shoe trees are not applicable to many types of shoes, such as those lacking any heel area, and do not readily lend themselves to hanging of shoes or suspension for display purposes. The normal purpose of a shoe tree is to maintain the shoe in an extended position conforming to the foot of the user so as to prevent the shoe from curling or bending when not in use. Stretchers are also available which can be fitted into the toe of a shoe and expanded for treating the shoe. Expansion normally is not automatic, but must be controlled by external manipulation. Stretchers are not normally used for display or storage purposes.

The present disclosure sets forth a relatively simple structure which can be inserted into almost any type of shoe having the usual instep and a vamp or strap forming a girth about the forward portion of the arch of the foot. As used herein, the term "shoe" refers to the normal oxfords and pumps, as well as low cut boots, protective outer shoes, slippers, sandals and similar footwear having a sole and a vamp structure arched over the sole to present a girth that encircles the forward portion of the arch of the foot. The vamp is normally defined as that portion of a shoe or boot upper that covers the instep and toes. The insole is that portion of the innersole in the shoe that normally supports the toes and instep.

SUMMARY OF THE INVENTION

The shoe hanger basically comprises an elongated core that is arranged longitudinally between the vamp and insole of a shoe. The core has means resiliently mounted to it along its length and extending a substantial distance outwardly for deforming frictional engagement against the inner surfaces of the shoe in which it is located. An external support is mounted to the core and protrudes outwardly from a shoe during use of the hanger. A pair of such inserts is normally used in conjunction with one another to mount a pair of shoes in an organized relationship for display or storage purposes. In one preferred form of the invention, the support is in the form of a hanger having an open hook at its upper end so that a pair of shoes can be suspended as a unit from a horizontal rod.

It is a first object of this invention to provide a relatively simple structure that is easily insertable or removable with respect to the wide range of shoe shapes and sizes. The insert is deformable to frictionally engage the inner surfaces of the shoe along a plurality of locations.

Another object of this invention is to provide a hanger that can readily suspend a pair of shoes so as to assist in organizing the display or storage of shoes.

These and further objects will be evident from the following disclosure, taken together with the accompanying drawings which illustrate two preferred forms of the invention.

DESCRIPTION OF THE DRAWINGS

FIG. 7 is a perspective view showing an alternate support assembly for the hangers;

FIG. 8 is a perspective view of an alternate hanger structure;

FIG. 9 is a top view of a second embodiment of the insert;

FIG. 10 is a side view of the second embodiment;

FIG. 11 is a transverse section taken along line 11—11 in FIG. 10;

DESCRIPTION OF THE PREFERRED EMBODIMENTS

Figure 1:
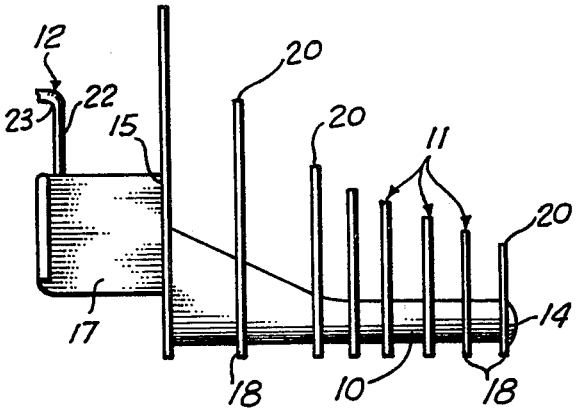
FIG. 1 is a side view of a first insert, with the support broken away.
Figure 2:
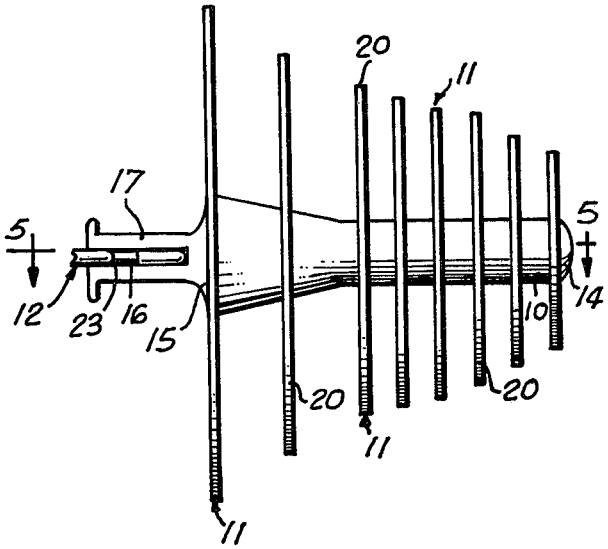
FIG. 2 is a top view of the insert as shown in FIG. 1.
Figure 3:
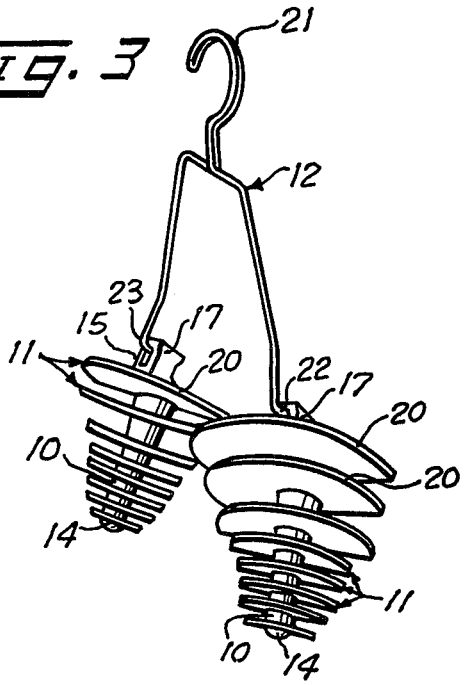
FIG. 3 is a perspective view of a complete hanger assembly.
Figure 4:
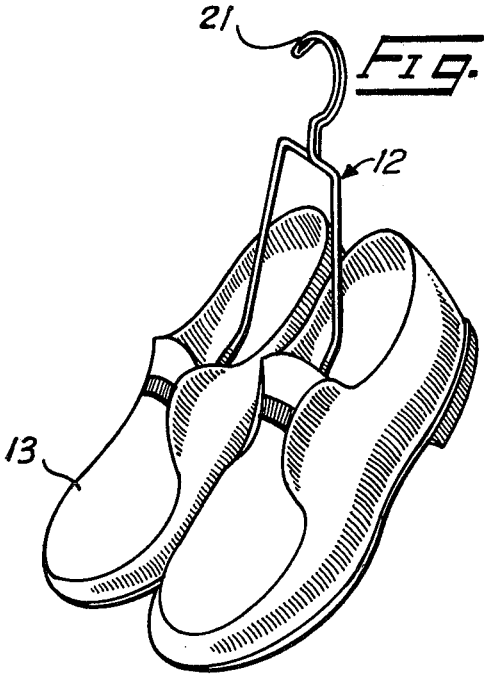
FIG. 4 is a perspective view showing a pair of shoes suspended on the hanger assembly.

A first form of the invention is illustrated in FIGS. 1 through 6. The hanger basically comprises an elongated core 10 designed to be inserted longitudinally between the vamp and insole of a shoe. Core 10 has a plurality of projections mounted to it, illustrated in the form of a plurality of transverse flexible fins 11. The fins 11 each protrude outwardly from the core 10 a substantial distance for deforming frictional engagement against the inner surfaces of the shoe. The fins engage the inner vamp surfaces and the insole of the shoe when wedged forwardly through the shoe opening. The outer end of core 10 is carried by a support 12 that extends rearwardly and upwardly from the core. The hanger normally comprises a pair of such inserts to support a pair of shoes 13 as seen in FIG. 4.

The core 10 and projections or fins 11 are preferably molded in one piece from a suitable resilient material, such as a resin or rubber material, which produces fins having flexibility and memory. Such fins are capable of readily bending to conform to the inner configuration of the shoe, and will return to their normal planar configuration when removed from the shoe. However, the core and projections can be separately molded or fabricated, and can be constructed of differing materials. For instance, metal fins, bristles or other projections might be resiliently mounted to a suitable core of plastic, wood, metal or other material to yieldably engage the inner surface of a shoe. The fins extend outwardly a substantial distance from core 10 so as to be capable of being inserted within a wide variety of shoe shapes and sizes. In actual practice, it has been found that almost all sizes of shoes can be displayed or stored on the structure shown in FIGS. 1 through 6 by using three sizes; the smallest size being adapted to be inserted within children's shoes; the intermediate size being adapted to be inserted within women's shoes, and the largest size being adapted to be inserted within men's shoes. There is some overlapping of sizes and shapes within these ranges and no specific size limitations are intended.

The core 10 is illustrated in FIGS. 1 through 8 as an elongated hollow arched channel having a front end 14 and a rear end 15. The rear end 15 has a rearwardly protruding tab 17 that has an aperture 16 at its upper edge to receive the outer end of support 12.

Fins 11 are normally planar and are individually arranged or oriented perpendicular to the length of the elongated core 10. They are spaced from one another along the length of the core 10. The spacing between individual fins 11 can be uniform or varies. Each fin 11 includes a straight transverse lower surface or edge 18 and a convex upper transverse surface or edge 20. The edges 18, 20 can be roughened or scalloped, as well as being smooth edges as shown in the accompanying drawings. The lower edges 18 are arranged coplanar to one another and at an elevation below the lower edges of core 10, so as to individually contact the insole surfaces of the shoe (see FIG. 5).

The respective width and height of each fin 11 are progressively enlarged along the length of core 10 from its front end 14 to its rear end 15. The amount of enlargement from fin to fin corresponds to the general amount of progressive enlargement encountered along the vamp within a shoe.

The normal combined width and height of the core 10 and fins 11 are respectively greater than the width and height of the adjacent inner vamp surfaces engaged thereby within a shoe. The width and height of the core 10 are respectively less than the width and height of the adjacent inner vamp surfaces within a shoe. Each insert is capable of adapting to a wide range of vamp configurations, so long as the shoe has a girth or inner circumference presenting a width and height less than the maximum width and height of the largest fin 11 and greater than the width and height of core 10, so that the insert can be reasonably wedged within the shoe.

FIGS. 1 through 6 show the hanger as a portable device capable of being suspended from a horizontal rod in a manner analogous to a clothes hanger. The support 12 includes an upper end in the form of an open hook 21. Hook 21 is formed of bent wire and includes two laterally spaced extensions formed downwardly therefrom in side by side relationship to one another. The lower ends of the extensions 22 terminate at a common distance from hook 21. The extensions 22 are free to flex or bend as needed to accommodate a pair of shoes. The lower end of each extension 22 is bent at 23 and fitted within the aperture 16.

Figure 5:
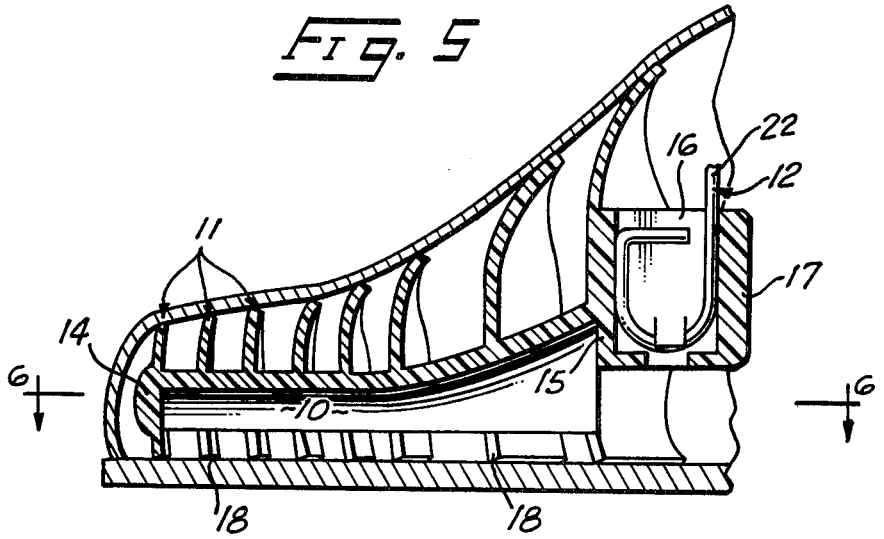
FIG. 5 is a longitudinal sectional view taken along the center of an insert within a shoe.
Figure 6:
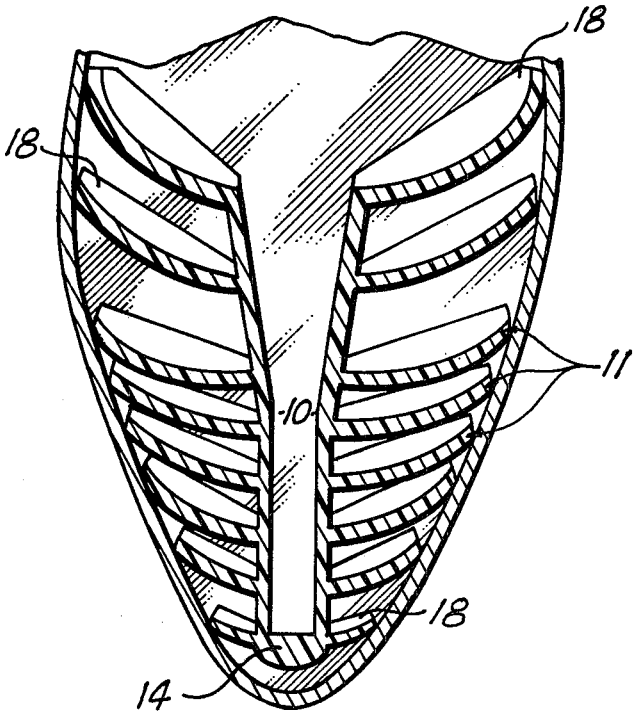
FIG. 6 is a transverse sectional view taken along line 6—6 in FIG. 5.
Figure 12:
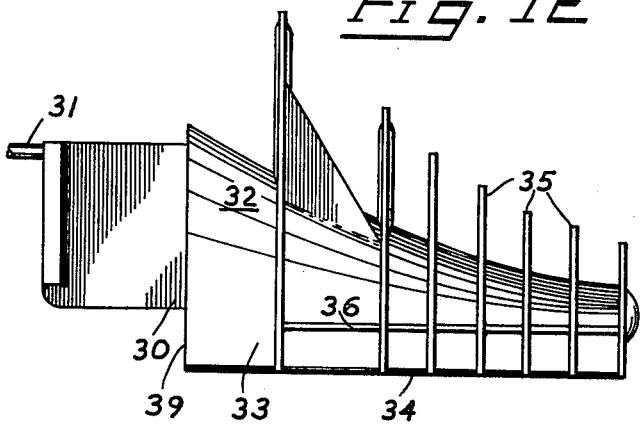
FIG. 12 is a side view of a third embodiment of the insert.
Figure 13:
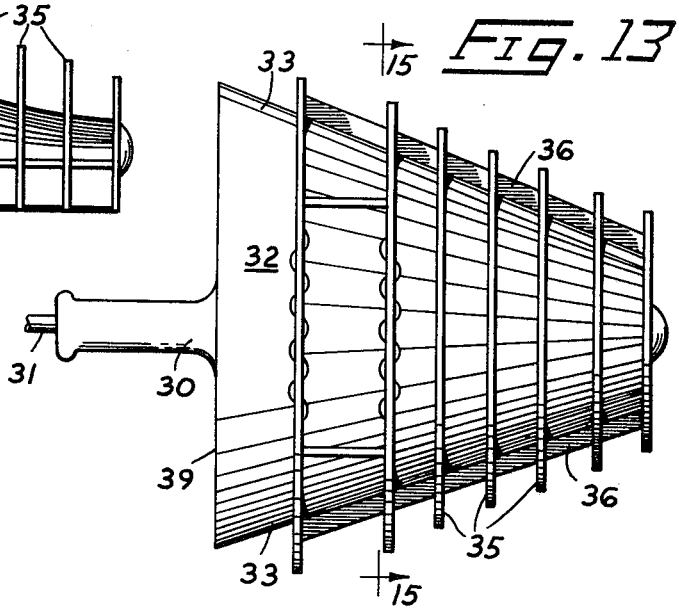
FIG. 13 is a top view of the insert as shown in FIG. 12.
Figure 14:
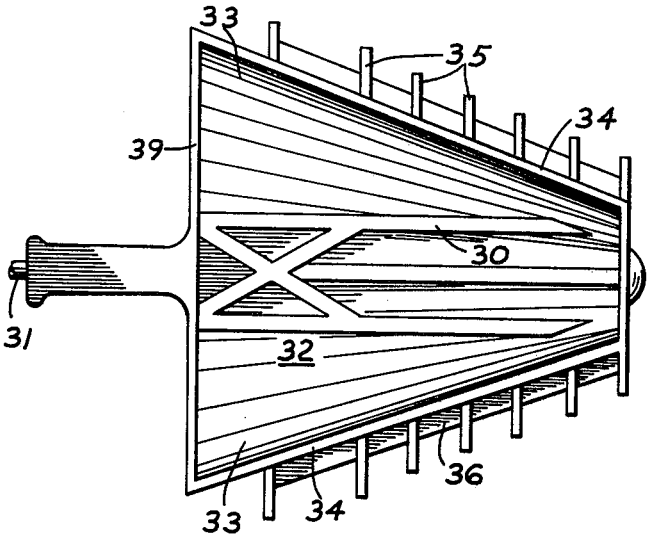
FIG. 14 is a bottom view of the insert as shown in FIG. 12.
Figure 15:
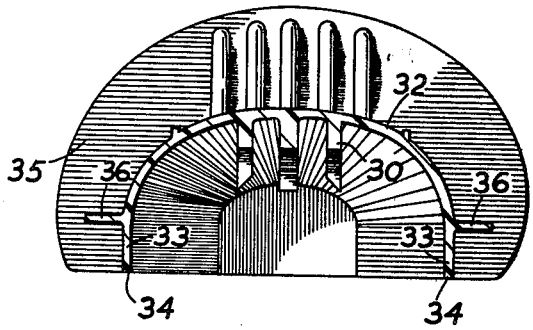
FIG. 15 is a transverse section taken along line 15—15 in FIG. 13.
Figure 16:
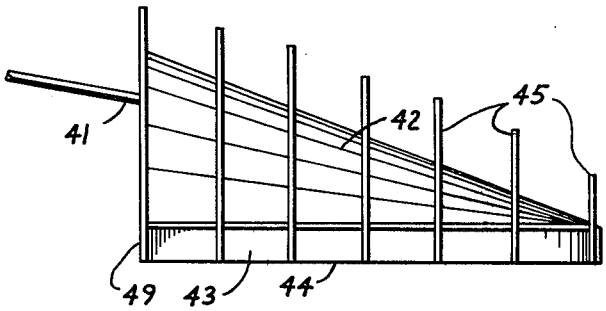
FIGS. 16 through 19 show a fourth embodiment and correspond to FIGS. 12 through 15 respectively.
Figure 17:
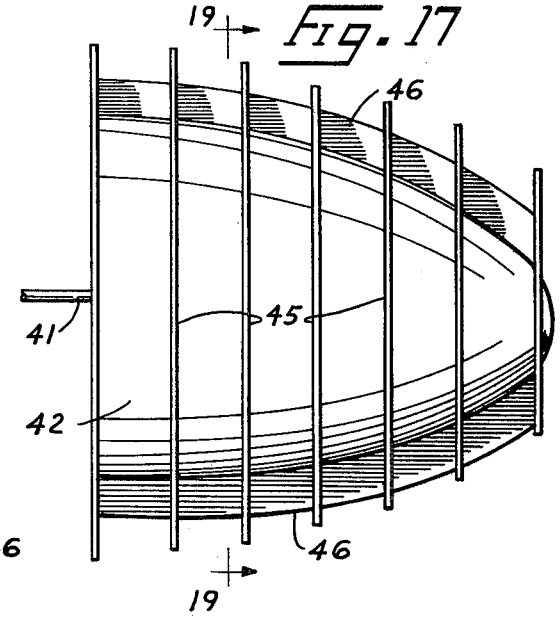
Figure 18:
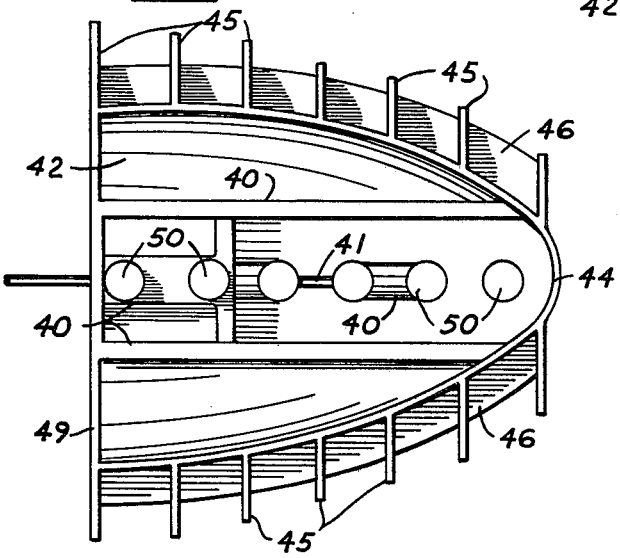

The hanger is used as shown in FIGS. 3 and 4. FIGS. 5 and 6 illustrate internal engagement of the insert within a typical shoe structure. The core 10 and fins 11 are manually pushed through the opening of the shoe. Fins 11 snugly engage and conform to the inner surfaces of the vamp and insole of the shoe. When the shoe is pulled from the hanger, the flexible fins 11 are capable of bending in a reverse direction to actually assist the shoe surfaces in slipping from the hanger. Being spaced along the core 10, the individual fins provide engagement and support of the shoe at a plurality of positions without undue pressure against the shoe surfaces, which might deform the shoe during extended storage. The shoe is gripped securely and does not pivot or move with respect to the hanger. When a large number of shoes are hung on a rod, each pair of shoes will be suspended in a similar attitude, which provides an attractive sales presentation in a retail outlet.

The deformable insert described above can also be used in other configurations of hangers and supports. FIGS. 7 and 8 illustrate two examples, showing multiple hangers. In FIG. 7, a number of paired inserts are mounted to a diagonal support frame 27, which can be suspended from a post or wall surface. In FIG. 8, a vertical hanger frame 28 also carries a number of paired inserts on transverse arms 30. The upper end of the hanger frame 28 has an open hook 31 for suspension on a horizontal bar or rod. Obviously, many other types of supports can be used in conjunction with the insert for suspending pairs of shoes in any desired spatial relationship.

FIGS. 9 through 11 show a second embodiment of the invention. In this embodiment, the core 24 is enlarged in relation to the more narrow form of core 10 shown in FIGS. 1 through 6. The core 24 basically conforms to the shape of the inner forward portion of a shoe, but is substantially less wide and high. Protruding bristles 25 extend above, to the sides, and below the core 24 a substantial distance to again engage and frictionally grip the inner surfaces of the vamp and insole. A suitable support 26 extends rearwardly from the core 24 in the manner generally discussed above.

The bristles 25 are preferably made from a resilient material, such as low density polyethelene resin, but could conceivably be made from rigid material if resiliently movable with respect to the core 24.

FIGS. 12 through 15 show another embodiment of the insert.

This third embodiment utilizes a core molded integrally with protruding fins, both the core and fins being deformable to conform to the interior shoe configuration as previously described.

The core includes a substantially rigid inner stem 30, having upright parallel walls. The stem 30 is relatively narrow and extends the full length of the insert from front to back, its rearmost extension providing means for attachment to a hanger or support 31.

An arched wall 32 is wrapped over the central stem 30. It is tapered both in width and in height, increasing in both dimensions from front to back. The arched wall terminates downwardly along sides 33 spaced transversely outward from the stem 30. Sides 33 present coplanar lower edges 34. The rearmost ends of the sides 33 are lightly joined to stem 30 by resilient end walls 39.

A plurality of resilient fins 35 is spaced along the length of the core radiating outward from the outer surface of arched wall 32 both transversely and upwardly. The lowermost edges of the fins 35 are coplanar with edges 34. Fins 35 are lightly interconnected by a horizontal rib 36 protruding outward from sides 33.

This third embodiment has been found to provide excellent grip within a shoe, since the projection of the resilient fins is substantially lessened in comparison to the insert illustrated in FIGS. 1 through 8. The sides 33 of the core frictionally contact the innersole surfaces of the shoe. The sides 33, ribs 36 and end walls 39 can compress inwardly to accommodate the interior configuration of the shoe. This provides substantial support for fins 35, while providing necessary resilience in the insert to accommodate a reasonable size range of shoes.

FIGS. 16 through 19 illustrate a commercial embodiment of the invention. It also utilizes a core molded integrally with protruding fins. The core and fins are also deformable to conform to the interior shoe configuration in a manner similar to the embodiment shown in FIGS. 12 through 15.

The core includes a substantially rigid inner stem 40, having upright parallel walls. The stem 40 is relatively narrow and extends the full length of the insert from front to back. The stem 40 does not protrude outwardly at the rear of the insert as in the prior structures, but means is provided for attaching an elongated end 41 of a hanger or support within a substantial length of the stem 40.

An arched resilient wall 42 is wrapped over the central stem 40 to complete the core. Wall 42 tapers both in width and in height, increasing in both dimensions from front to back along the insert. It conforms in size and shape substantially to the interior shoe surfaces at the front of the smallest shoe size for which it is designed.

Figure 19:
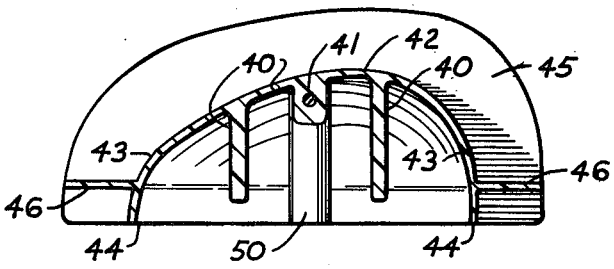

As can be seen in FIG. 19, the insert in this embodiment is shaped to fit either a left shoe or a right shoe, the two inserts being mirror images of one another. The arched wall 42 conforms to the interior shoe configuration in height, in length and in transverse dimensions. Wall 42 terminates downwardly along curved sides 43 spaced transversely outward from the stem 40. The sides 43 present coplanar lower edges 44. The rearmost ends of the sides 43 are lightly joined to the stem 40 by resilient end walls 49. The end walls 49 are also flexible or resilient and can partially collapse when wedged within a shoe.

A plurality of resilient fins 45 are spaced along the length of the core and radiate outward from the outer surface of arched wall 42 both transversely and upwardly. The lowermost edges of the fins 45 are coplanar with edge 44. The fins 45 are lightly interconnected by a horizontal rib 46 protruding outwardly from the sides 43. The outer edges of fins 45 conform in size and shape to the interior surface configurations of a shoe, in this case the largest size shoe for which the particular insert is designed.

The underside of stem 30 includes a series of downwardly protruding solid pins 50 which terminate along lower ends coplanar with the lower edges 44 of the sides 43 and the lowermost edges of fins 45. The pins 50 are aligned along the center of the insert and are also molded integrally with the remainder of the insert. They serve as resilient means to engage the center line of the shoe interior to prevent vertical collapse of the insert along its center line and to provide additional frictional engagement against the insole of the shoe when the insert is wedged forwardly through the shoe opening.

This embodiment conforms more closely to the interior shoe configurations than do the previously-described embodiments. It is capable of effectively holding shoes ranging in size from the smaller size approximated by the shape of the arched wall 42 to the larger size approximated by the outer shape of the fins 45. Because the arched wall 42 and the fins 45 of each insert conform in shape to a left or right shoe, the flexing of the fins and wall surfaces are more uniform along the areas engaged by them. The resilient wall 42 supports the fins 45, which are also resilient, and the two cooperatively bend as necessary to mate with the contacted surfaces of a shoe interior. Since the projection of the fins 45 is lessened in comparison to the insert illustrated in FIGS. 1 through 8, substantially more force is exerted on the shoe by each fin to assure a firm grip between the insert and the shoe.

In all embodiments of the invention, there must be a series of projections resiliently or yieldably mounted to a framework or core and extending outward beyond the supporting framework or core so that these projections can flex, bend or move yieldably to accommodate shoes of various shapes and sizes. The object of the shoe insert is to frictionally grip the inner surfaces of the shoe without deforming the shoe in any way. Their purpose is to support the shoe and to suspend it for display and storage purposes. This purpose can obviously be achieved by many variations of the structures illustrated, and such variations are intended to come within the scope of this disclosure, so long as they fall within the language of the claims which follow.

Having described my invention, I claim:

1. A shoe hanger comprising:

elongated core means for longitudinal insertion between the vamp and insole of a shoe;

a plurality of projections resiliently mounted to the core means, each extending substantially transversely outward therefrom for deformable frictional engagement with inwardly facing interior surfaces of a shoe, said projections being spaced apart along the length of the core means;

and support means mounted to said core means;

the height and width across said projections being increased from front to back.

2. A shoe hanger as set out in claim 1 wherein said projections substantially surround the core means transverse to the length of the core means and extend also below and to the sides of the core means.

3. A shoe hanger as set out in claim 1 wherein the support means extends rearwardly and upwardly from said core means when inserted within a shoe.

4. A shoe hanger as set out in claim 1 wherein the width and height of the core means are respectively less than the corresponding width and height of the adjacent inner vamp surfaces within a shoe.

5. A shoe hanger as set out in claim 1 wherein the width and height of the core means are respectively less than the width and height of the adjacent inner vamp surfaces within a shoe and wherein the normal combined width and height of the core means and projections are respectively greater than the width and height of the adjacent inner vamp surfaces engaged thereby within a shoe.

6. A shoe hanger as set out in claim 1 wherein said projections comprise a plurality of randomly located bristles radiating outward from the core means.

7. A shoe hanger as set out in claim 1 wherein the core means comprises a tapered member increasing progressively in both width and height from front to back and having deformable side walls capable of being compressed inwardly when inserted within a shoe.

8. A shoe hanger as set out in claim 1 wherein the core means comprises a tapered member increasing progressively in both width and height from front to back and having deformable side walls capable of being compressed inwardly when inserted within a shoe;

said projections comprising a plurality of flexible fins each having a normally planar configuration perpendicular to the length of the tapered member, said fins being arranged along the length of the tapered member at spaced positions parallel to one another;

each of said fins having a straight transverse lower edge adapted to engage the instep of a shoe and a convex transverse upper edge adapted to engage the inner vamp surfaces of a shoe;

wherein the lower edges of the fins are coplanar;

and the respective width and height of each fin being progressively enlarged about the length of said tapered member from front to back, the amount of enlargement corresponding to the amount of progressive enlargement encountered along the vamp within a shoe.

9. A shoe hanger as set out in claim 1 wherein the core means comprises a tapered member increasing progressively in both width and height from front to back and having deformable side walls capable of being compressed inwardly when inserted within a shoe, said tapered member conforming in both size and shape to the complementary interior size and shape of the front portion of the smallest sized shoe for which it is designed;

said projections comprising a plurality of flexible fins each having a normally planar configuration perpendicular to the length of the tapered member, said fins being arranged along the length of the tapered member at spaced positions parallel to one another;

each of said fins having a straight transverse lower edge adapted to engage the instep of a shoe and a convex transverse upper edge adapted to engage the inner vamp surfaces of a shoe;

wherein the lower edges of the fins are coplanar;

and the respective width and height of each fin being progressively enlarged about the length of said tapered member from front to back, the lower and upper edges of said fins conforming in both size and shape to the complementary interior size and shape of the front portion of the largest size shoe for which it is designed.

10. A shoe hanger comprising:

elongated core means for longitudinal insertion between the vamp and insole of a shoe;

a plurality of projections resiliently mounted to the core means, each extending substantially transversely outward therefrom for deformable frictional engagement with inwardly facing interior surfaces of a shoe, said projections being spaced apart along the length of the core means;

and support means mounted to said core means;

said projections being comprised of a plurality of transverse flexible fins arranged parallel to one another along the length of the core means.

11. A shoe hanger as set out in claim 10 wherein said flexible fins each has a normally planar configuration perpendicular to the length of the core means.

12. A shoe hanger as set out in claim 10 wherein said flexible fins each has a normally planar configuration perpendicular to the length of the core means; and each of said fins has a straight transverse lower edge adapted to engage the instep of a shoe and a convex transverse upper edge adapted to engage the inner vamp surfaces of a shoe.

13. A shoe hanger as set out in claim 10 wherein said flexible fins each has a normally planar configuration perpendicular to the length of the core means;

each of said fins having a straight transverse lower edge adapted to engage the instep of a shoe and a convex transverse upper edge adapted to engage the inner vamp surfaces of a shoe; and wherein the lower edges of the fins are coplanar.

14. A shoe hanger as set out in claim 10 wherein said flexible fins each has a normally planar configuration perpendicular to the length of the core means;

each of said fins having a straight transverse lower edge adapted to engage the instep of a shoe and a convex transverse upper edge adapted to engage the inner vamp surfaces of a shoe;

wherein the lower edges of the fins are coplanar;

the respective width and height of each fin being progressively enlarged along the length of said core means from front to back, the amount of enlargment corresponding to the amount of progressive enlargement encountered along the vamp within a shoe.

15. A shoe hanger, comprising:

a longitudinal core having front and rear ends;

a plurality of projections resiliently mounted to the core and extending upwardly, downwardly and to the sides thereof at locations spaced along the length of the core;

said projections having deformable outer surfaces that are coplanar along a first plane located beneath the core and which progressively increase in width and height from the front end of the core to the rear end thereof; and support means mounted to the rear end of the core and extending rearwardly and upwardly in relation to said first plane.

16. A shoe hanger as set out in claim 15 wherein said projections comprise a plurality of transverse flexible fins arranged parallel to one another along the length of the longitudinal core.

17. A shoe hanger as set out in claim 15 wherein said projections comprise a plurality of transverse flexible fins arranged parallel to one another along the length of the longitudinal core;

each of said fins having a straight transverse lower edge adapted to engage the instep of a shoe and a convex transverse upper edge adapted to engage the inner vamp surfaces of a shoe.

18. A shoe hanger as set out in claim 15 wherein said projections comprise a plurality of randomly located bristles radiating outward from the core.

19. A shoe hanger as set out in claim 15 wherein the core is tapered and increases progressively in both width and height from front to back and has deformable side walls capable of being compressed inwardly when inserted with a shoe.

20. A a shoe hanger comprising in combination:

a bent wire support having a hook formed at its upper end and two laterally spaced extensions depending downward therefrom in side by side relationship to one another, the lower ends of said extensions terminating at a common distance from the hook;

and a pair of shoe inserts mounted respectively to the lower ends of the extensions, each insert comprising:

elongated core means for longitudinal insertion between the vamp and insole of a shoe;

a plurality of projections resiliently mounted to the core means, each projection extending substantially transversely outward therefrom for deformable frictional engagement with inwardly facing interior surfaces of the shoe, said projections being spaced apart along the length of the core means.

21. A shoe hanger as set out in claim 20 wherein said projections comprise a plurality of transverse flexible fins arranged parallel to one another along the length of the elongated core means.

22. A shoe hanger as set out in claim 20 wherein said projections comprise a plurality of transverse flexible fins arranged parallel to one another along the length of the elongated core means;

each of said fins having a straight transverse lower edge adapted to engage the instep of a shoe and a convex transverse upper edge adapted to engage the inner vamp surfaces of a shoe.

23. A shoe hanger as set out in claim 20 wherein said projections comprise a plurality of randomly located bristles radiating outward from the core means.

24. A shoe hanger as set out in claim 20 wherein the core means for each insert comprises a tapered member increasing progressively in both width and height from front to back and having deformable side walls capable of being compressed inwardly when inserted within a shoe;

said projections comprising a plurality of flexible fins each having a normally planar configuration perpendicular to the length of the tapered member, said fins being arranged along the length of the tapered member at spaced positions parallel to one another;

each of said fins having a straight transverse lower edge adapted to engage the instep of a shoe and a convex transverse upper edge adapted to engage the inner vamp surfaces of a shoe;

wherein the lower edges of the fins are coplanar;

and the respective width and height of each fin being progressively enlarged about the length of said tapered member from front to back, the amount of enlargement corresponding to the amount of progressive enlargement encountered along the vamp within a shoe.

25. A shoe hanger as set out in claim 20 wherein the core means for each insert comprises a tapered member increasing progressively in both width and height from front to back and having deformable side walls capable of being compressed inwardly when inserted within a shoe, said tapered member conforming in both size and shape to the complementary interior size and shape of the front portion of the smallest sized shoe for which it is designed;

said projections comprising a plurality of flexible fins each having a normally planar configuration perpendicular to the length of the tapered member, said fins being arranged along the length of the tapered member at spaced positions parallel to one another;

each of said fins having a straight transverse lower edge adapted to engage the instep of a shoe and a convex transverse upper edge adapted to engage the inner vamp surfaces of a shoe;

wherein the lower edges of the fins are coplanar;

and the respective width and height of each fin being progressively enlarged about the length of said tapered member from front to back, the lower and upper edges of said fins conforming in both size and shape to the complementary interior size and shape of the front portion of the largest size shoe for which it is designed.

* * * * *